United States Patent [19]

Dosch et al.

[11] 3,943,692

[45] Mar. 16, 1976

[54] MOUNTING ASSEMBLY FOR MEASURING PROBE ON FALSE-TWIST MACHINES

[75] Inventors: Peter Dosch, Jona; Dieter Dorsch, Ebnat-Kappel, both of Switzerland

[73] Assignee: APAG Apparatebau AG, Switzerland

[22] Filed: May 20, 1974

[21] Appl. No.: 471,794

[52] U.S. Cl. ..... 57/77.45; 57/34 R; 248/225; 248/310; 248/DIG. 4

[51] Int. Cl.[2] ..... D01H 13/32

[58] Field of Search ..... 57/34 R, 77.45, 93, 92, 57/34 HS; 248/223, 224, 225, 309, 310, DIG. 4

[56] References Cited

UNITED STATES PATENTS

| | | | |
|---|---|---|---|
| 1,486,908 | 3/1924 | Lowe | 248/DIG. 4 |
| 1,801,067 | 4/1931 | Bodine | 248/310 X |
| 1,853,402 | 4/1932 | Braly | 248/310 X |
| 2,447,624 | 8/1948 | Akert | 248/DIG. 4 |
| 2,911,700 | 11/1959 | Wieland | 248/310 X |
| 3,316,699 | 5/1967 | Mattingly | 57/93 |
| 3,662,531 | 5/1972 | Carroll | 57/34 HS |
| 3,665,306 | 5/1972 | Orth | 57/77.45 X |

*Primary Examiner*—John Petrakes
*Attorney, Agent, or Firm*—Larson, Taylor and Hinds

[57] ABSTRACT

A measuring probe assembly for continuously measuring the revolution speed of a twist tube of a false-twist machine is described. The measuring probe is detachably secured on a holder device which in turn is detachably secured to a texturing device detachably mounted on the machine. A flexible connection cable is permanently fixed to contacts on the measuring probe and leads to a display device. Thus, the measuring probe can be detached without breaking the electrical connection to the probe.

5 Claims, 4 Drawing Figures

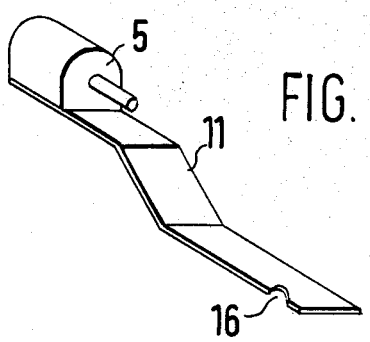
FIG. 2
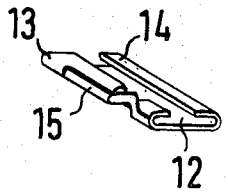
FIG. 1
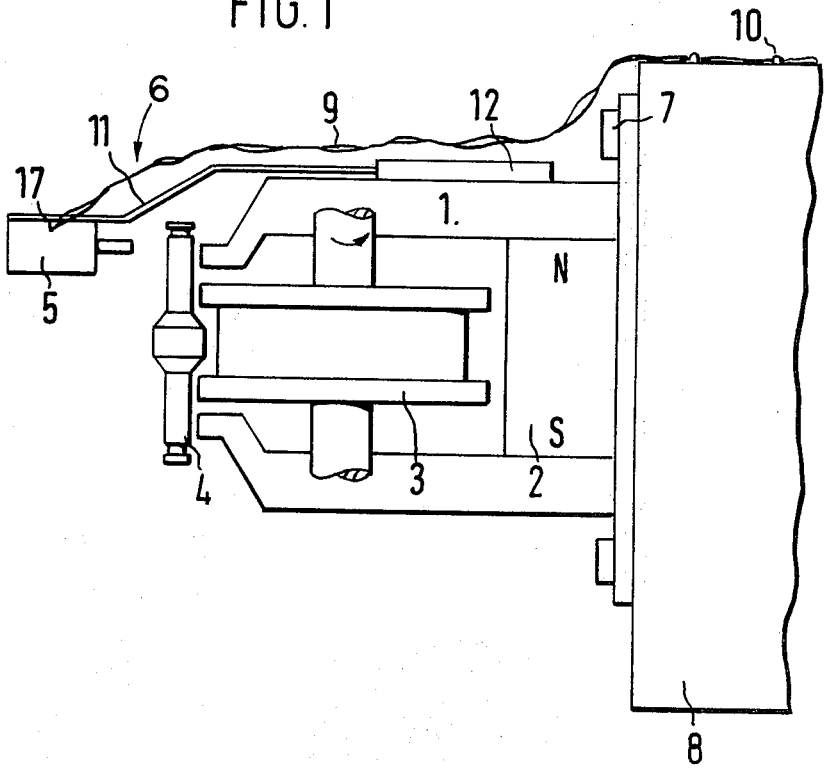

MOUNTING ASSEMBLY FOR MEASURING PROBE ON FALSE-TWIST MACHINES

FIELD OF THE INVENTION

The present invention relates to an assembly comprising a measuring probe for continuously measuring the revolution speed of a twist tube in a false-twist machine, wherein the measuring probe is stationarily mounted on a texturing device, which is separatable from the false-twist machine, by means of a holder device and is connected with a display device by means of a connecting cable.

DESCRIPTION OF THE PRIOR ART

It is generally known and usual to arrange revolution speed measuring probes stationarily on the texturing devices of false-twist machines. The survey of the revolution speed may either be effected cyclically or continuously using suitable measuring and display devices.

In the known arrangements of measuring probes, the connecting cable is connected with the probe by means of a plug connection. This results from the fact that the texturing devices have to be separated from the machine at regular intervals for effecting maintenance work thereon, so that the measuring probes rigidly fixed on the texturing devices must then be removed together with the texturing devices. Since the signals delivered by the measuring probes have extremely low amplitudes, special requirements are necessary for the plug connections: firstly, a contact metal is necessary which resists to all deleterious operation conditions and environmental influences and which has a low contact resistance, and secondly it must be possible to separate the connection rapidly but, when connected, to maintain safe contact even under the influence of mechanical shocks. In view of the large number of measuring probes arranged on one machine, there is furthermore the requirement for extremely low cost per connection.

SUMMARY OF THE INVENTION

It is the purpose of the present invention to avoid the disadvantages of the known devices and particularly to provide a measuring probe which provides increased operative efficacy during transmission of the measure signals and furthermore is economical.

According to the present invention, this purpose is primarily achieved by combination of the following features:

a holder device for a measuring probe in a measuring probe assembly is provided with a rapidly separatable and reconnectable attachment device for connecting the holder to a texturing device, or for connecting the holder to the measuring probe, a connection cable is stationarily arranged on the frame of the false-twist machine, the connection cable is permanently and inseparably connected with the measuring probe.

As will be seen, the above combination of features makes it possible on the one hand to eliminate the plug connection between the measuring probe and connection cable which decisively increases the reliability of signal transmission, and on the other hand, the cost of one pair of plugs per measuring station is eliminated. Since the mechanical attachment device for the holder device can be made without difficulty and without high expenditure, the invention provides essential economical and technical advantages.

Advantageously, the connection cable is directly soldered on the connection terminals of the measuring probe.

The attachment device can be made in a most easy manner if the holder device comprises a resilient part which is shaped to engage with a receiving part fixed on the texturing device.

Advantageously, the holder device may consist of a part rigidly fixed on the texturing device, the measuring probe being mounted on the said part by means of a rapidly detachable fastening device.

DESCRIPTION OF THE DRAWINGS

The present invention will hereinafter be explained in more detail by means of examples with reference to the accompanying drawings wherein:

FIG. 1 is an elevation of a measuring probe which is fixed on the texturing device of a false-twist machine by means of a holder device;

FIG. 2 is a perspective view of the holder device of FIG. 1 as seen from above and on a larger scale;

Referring to FIG. 1, a measuring probe 5 is fixed on a texturing device consisting of holder 1, holding magnet 2, disc 3 and twist tube 4 by means of a holder device indicated generally by the reference numeral 6. The texturing device itself is fixed on the machine frame 8 by means of screws 7 in such a manner that it can be rapidly detached therefrom. A connection cable 9 which connects the measuring probe 5 with a display device (not shown) is also fixed along the machine frame by means of clamps 10. The holder device 6 consists of a holder part 11 fixed on the measuring probe 5, the holder part 11 being engageable in a receiving part 12 fixed on the holder 1. The connection cable however is soldered onto contacts 17 on the measuring probe 5.

Figure 3:
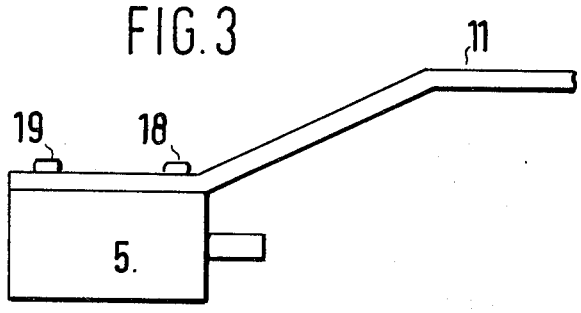
FIG. 3 is a side elevation of a measuring probe arranged on a holder device.

As appears particularly from FIG. 2, the holder part 11 consists of a metal strip which can be inserted beneath two flanges 13, 14 of the receiving part 12. For fixing the measuring probe 5 in the desired relative position with respect to the twist tube 4, a spring 15 is provided on the receiving part 12 which, when the holder part 11 is mounted therein engages in a recess 16 provided on the latter so that the probe is securely fastened in position.

As the connection cable 9 is laid along the machine frame relatively loosely it is easy before removing the texturing device, to separate the measuring probe 5 from the latter merely by separating the holder part 11 from the receiving part 12. The probe 5 is then still connected mechanically with the machine frame 8 by means of connection cable 9.

Figure 4:
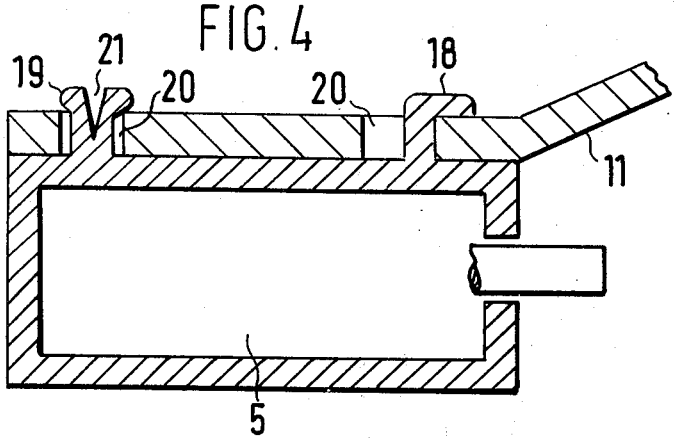
FIG. 4 is a vertical section on an enlarged scale through a portion of the assembly of FIG. 3.

Referring to FIGS. 3 and 4, a measuring probe 5 is fixed on a texturing device (not shown) by means of a holder part 11. The holder part comprises at its outer end openings 20 with which a hook 18 and a projection 19 in the measuring probe 5 are engaged and therefore safely keep the measuring probe in place.

As especially appears from FIG. 4, the projection 19 consists of a snap-in device made resilient by a recess 21, which can be pressed into the opening 20 while undergoing temporary resilient deformation.

As will be seen, when replacing the measuring probe or the texturing device, the measuring probe 5 can be separated from the holder part 11 easily enabling the replacement part to be mounted on the machine.

Naturally, the objects of the present invention are not necessarily associated with the described embodiment either of the texturing device or of the holder device. It is rather primarily essential that the measuring probe should be separable from the machine frame in a very easy manner, the place at which separation takes place being situated either on the machine frame or on the measuring probe; furthermore, it is necessary for achieving the desired reliable electrical contact that the connection cable, as shown by the example, should be permanently connected with the measuring probe. Instead of soldering, it is of course also possible to secure the connection cable by means of clamping screws or by similar means.

We claim:

1. A measuring probe assembly for continuously measuring the revolution speed of a twist tube of a false-twist machine, said assembly comprising a texturing device including a twist tube and said device being adapted to be detachably mounted on the machine, a measuring probe for continuously measuring the revolution speed of said twist tube, said measuring probe having contacts for a connection cable, a holder device for said measuring probe providing sole support for said measuring probe when in use, mounting means stationarily securing said holder device to said texturing device, mounting means stationarily securing said measuring probe to said holder device, one of said mounting means providing for rapid separation and reconnection of said measuring probe with respect to said texturing device, a flexible connection cable for connecting said measuring probe to a display device, one end of said cable being fixed permanently to said contacts and means for securing said cable along a length thereof to the machine.

2. An assembly according to claim 1, wherein a soldered connection is provided between said end of said connection cable and said contacts.

3. An assembly according to claim 1, wherein said holder device comprises a receiving part permanently and rigidly secured to said texturing device, a holder part detachably mounted in said receiving part and a spring for resiliently latching said holder part in said receiving part.

4. An assembly according to claim 1, wherein said holder device is rigidly fixed to said texturing device and said mounting means stationarily securing said measuring probe to said holder device provide for rapid separation and reconnection of said measuring probe to said holder device.

5. An assembly according to claim 4, wherein said holder device is formed with two openings and said measuring probe includes a hook engaging one said opening and a projection formed resiliently to engage the other said opening.

* * * * *